United States Patent [19]

Gillespie et al.

[11] Patent Number: 4,578,111

[45] Date of Patent: Mar. 25, 1986

[54] FURNACE AND PROCESS FOR PROVIDING A SOURCE OF MOLTEN METAL

[75] Inventors: John R. Gillespie, Ballwin; Daniel M. Corley, Eureka, both of Mo.

[73] Assignee: Gillespie & Powers, Inc., St. Louis, Mo.

[21] Appl. No.: 730,120

[22] Filed: May 3, 1985

[51] Int. Cl.[4] ..... C22B 9/16; F27B 3/04

[52] U.S. Cl. ..... 75/65 R; 75/68 R; 266/200; 266/900; 266/901

[58] Field of Search ..... 75/65 R, 68 R; 266/200, 266/900, 901

[56] References Cited

U.S. PATENT DOCUMENTS

| | | | |
|---|---|---|---|
| 3,869,112 | 3/1975 | Habayeh | 75/43 |
| 4,010,935 | 3/1977 | Stephens | 75/65 R |
| 4,021,192 | 5/1977 | Ferguson et al. | 266/200 |
| 4,055,334 | 10/1977 | Stephens | 266/901 |
| 4,319,921 | 3/1982 | Pryor et al. | 266/901 |
| 4,353,532 | 10/1982 | Jay | 266/901 |

*Primary Examiner*—Melvyn J. Andrews

*Attorney, Agent, or Firm*—Gravely, Lieder & Woodruff

[57] ABSTRACT

A furnace for providing a source of molten aluminum or other metal includes a main chamber and a sweat chamber, the floor of which constitutes a sweat hearth on which ingots or sows are placed. A division wall separates the sweat chamber from the main chamber, and this wall contains ports located at the level of sweat hearth for providing communication between the two chambers. Each chamber, moreover, contains its own set of burners and has a discharge stack leading away from it. Each stack in turn has a refractory damper in it. The burners within the main chamber maintain the bath in a molten condition, and when these burners are in operation, the damper in the stack leading from the main chamber is closed, while the damper in the stack leading from the sweat chamber is open. Thus, the hot gases flow through the ports in the division wall and thence through the sweat chamber to the stack leading from that chamber. The hot gases preheat the sows. The burners in the sweat chamber are only operated after the main burners are shut off and the dampers reversed opened. The sweat burners melt the sows, and the molten metal flows into the bath through the ports in the division wall. The hot gases again flow through the division wall, but in the reverse direction, and thus pass through the main chamber to the stack leading from that chamber, through which they are vented. The gases thus maintain the bath in a molten condition.

20 Claims, 6 Drawing Figures

FURNACE AND PROCESS FOR PROVIDING A SOURCE OF MOLTEN METAL

BACKGROUND OF THE INVENTION

This invention relates in general to furnaces and more particularly to a furnace and process for melting metals so as to provide a source of molten metal.

Aluminum and its alloys melt at relatively low temperatures, and this coupled with other desirable characteristics, render aluminum ideal for casting and extruding operations. It is quite common to derive the molten aluminum for these operations from a furnace into which both aluminum ingots or sows and aluminum scrap are introduced. The sows, however, require special precautions in handling, because they may, if introduced into a bath of molten aluminum produce an explosion. In this regard, the typical cast aluminum sow often contains shrinkage cracks in which water collects, and this water if suddenly elevated in temperature, such as might occur if the sow were deposited into the bath of molten aluminum, could well produce an explosion of sufficient magnitude to destroy the furnace.

For this reason it is common to slowly preheat aluminum sows so a to vaporize the water and drive it off before the sows are introduced into the molten aluminum. Such preheating may take place within the melting furnace itself or in a separate preheating furnace.

In this regard, the typical aluminum furnace has a sill located to the side of the molten aluminum bath and exposed in its entirety to the heated chamber over the bath. This chamber is heated by burners which are directed into it, and these burners supply enough heat to melt the aluminum and maintain it in a molten condition. The sows to the side of the bath absorb much heat from the chamber, both through the effects of radiation and convection, and indeed the latter is enhanced by venting the chamber through the region in which the sows are located, so that the heated gases flow across the sows as they leave the chamber. In time the sows melt and molten aluminum which is produced flows into the bath, thus adding to the bath.

The presence of a large number of sows in the chamber enables the sows to absorb heat which might otherwise be directed into the aluminum bath to maintain the aluminum of that bath molten. In other words, the walls of the melting chamber, instead of radiating heat almost entirely into the bath, radiate a substantial amount of heat to the sows. This wastes energy in that the chamber must be overheated to effect a melting of the sows.

SUMMARY OF THE INVENTION

One of the principal objects of the present invention is to provide a furnace and process that is ideally suited for melting metals, including aluminum sows. Another object is to provide a furnace and process of the type stated in which the molten bath of metal is on all sides exposed to chamber walls which radiate heat back into the chamber and to the bath contained in it. A further object is to provide a furnace and process of the type stated which is highly efficient. An additional object is to provide a furnace and process of the type stated in which sows are heated and melted in a chamber separate from the chamber to which the bath of molten metal is contained, with each chamber having its own burners, and when one chamber is heated the hot gases from it flow through the other chamber to provide heat for that other chamber. Still another object is to provide a furnace of the type stated in which the chamber where the sows are melted may be heated with burners that are directed into that chamber. Yet another object is to provide a furnace which may be loaded without exposing the high temperature melting chamber of the furnace. Still another object is to provide a furnace and process which uses two chambers, each having its own burners, own flue and damper for such flue, so that hot gases produced by the burners of one chamber may be directed through the other chamber to supply heat to that other chamber.

DESCRIPTION OF THE DRAWINGS

In the accompanying drawings which form part of the specification and wherein like numerals and letters refer to like parts wherever they occur.

DETAILED DESCRIPTION

Figure 1:
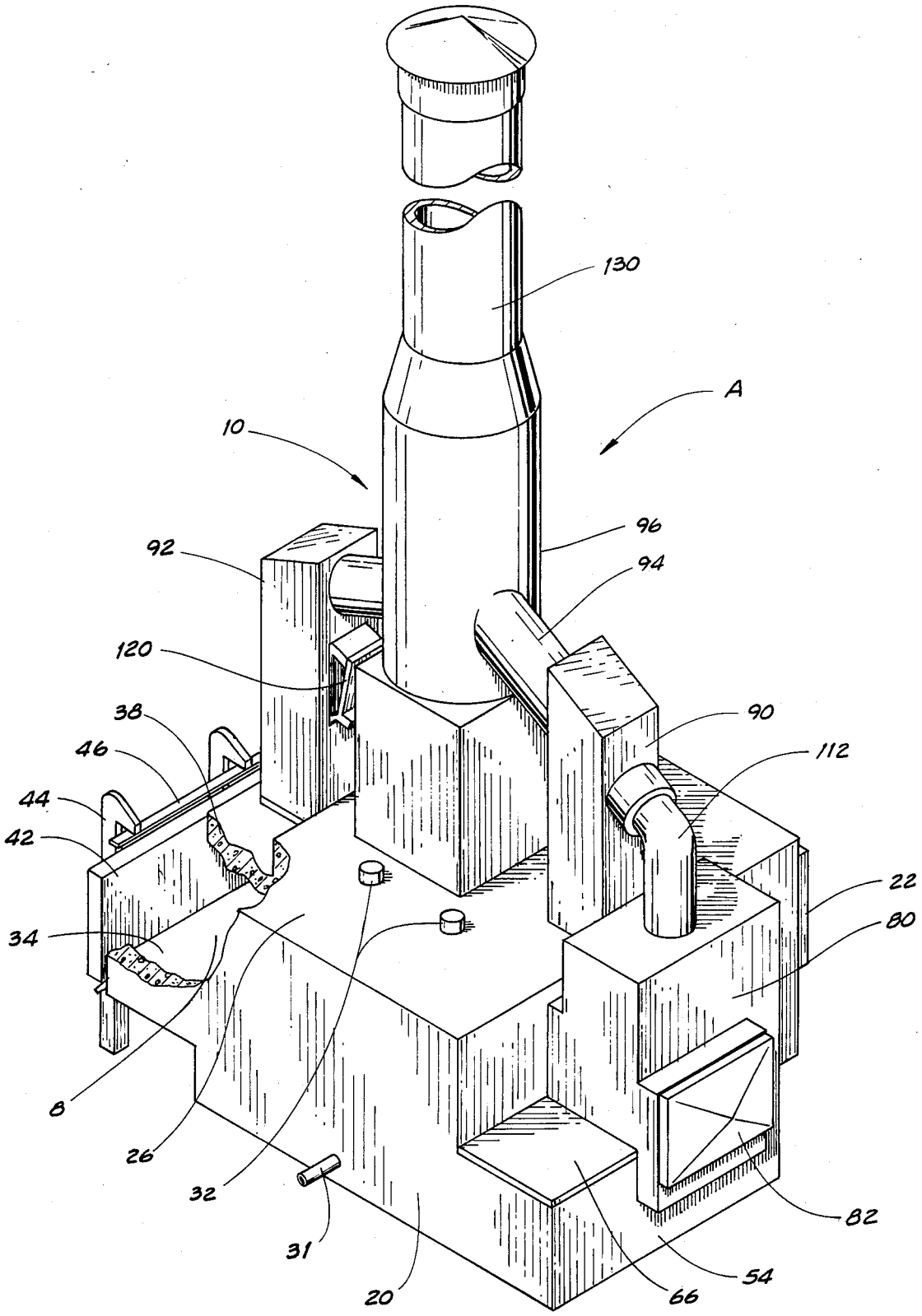
FIG. 1 is a perspective view of a furnace constructed in accordance with and embodying the present invention, the furnace being partially broken away and in section at its sweat hearth.
Figures 2, 6:
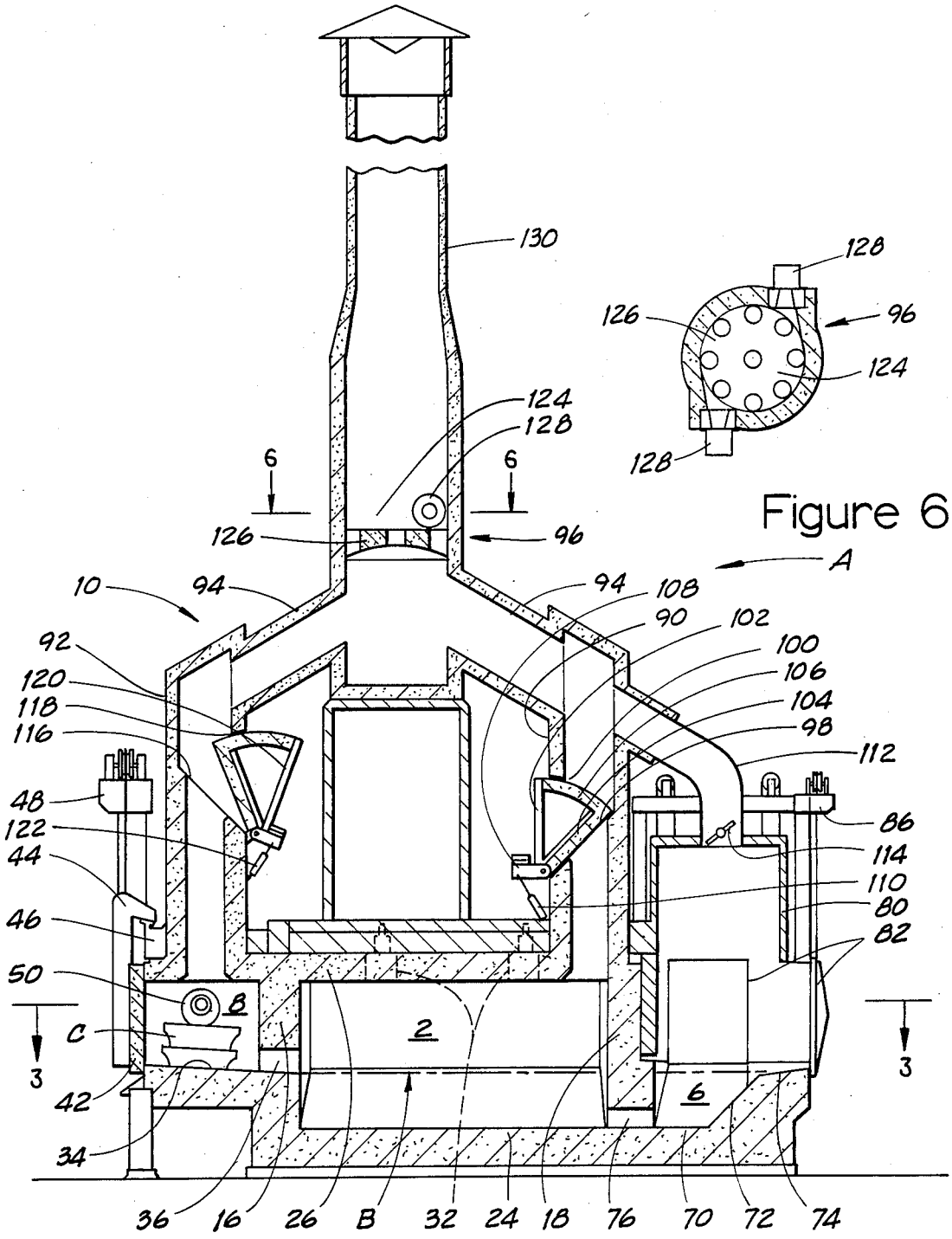
FIG. 2 is an elevational sectional view of the furnace.
FIG. 6 is a sectional view taken along line 6—6 of FIG. 2 and showing the reaction chamber for the flue system.
Figure 3:
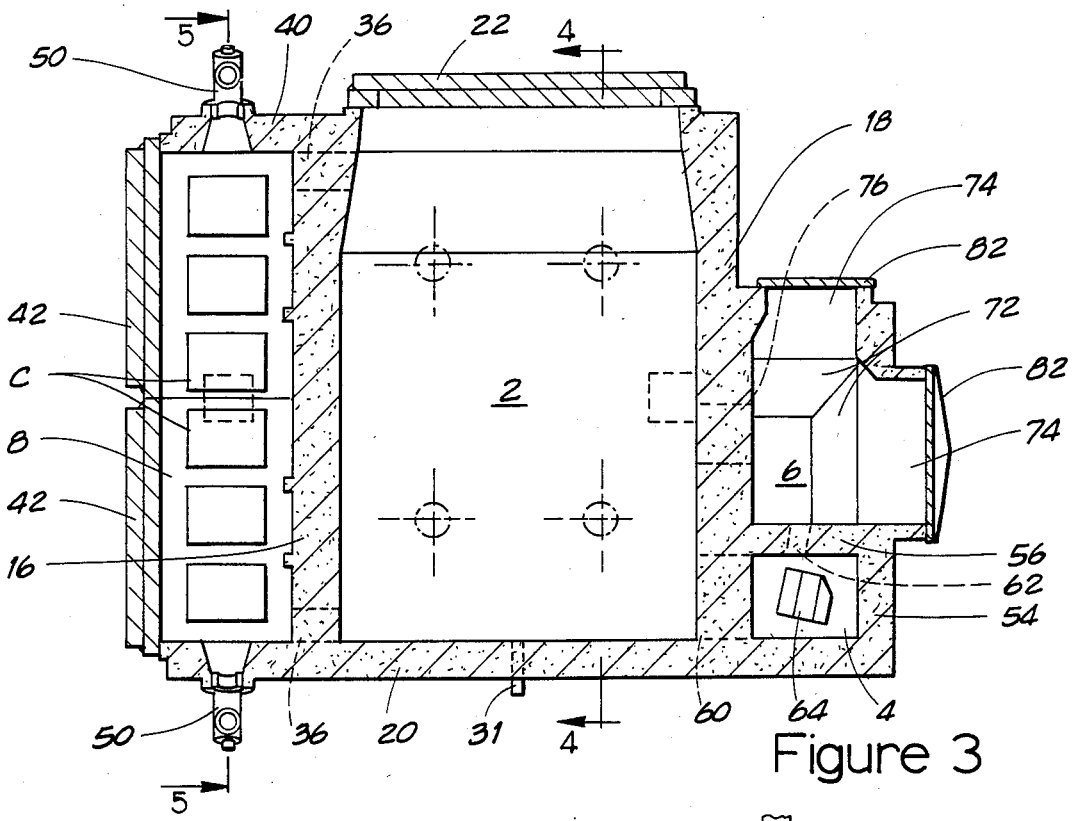
FIG. 3 is a sectional view taken along line 3—3 of FIG. 2 and showing the main chamber burners and the discharge stacks in phantom lines.
Figure 5:
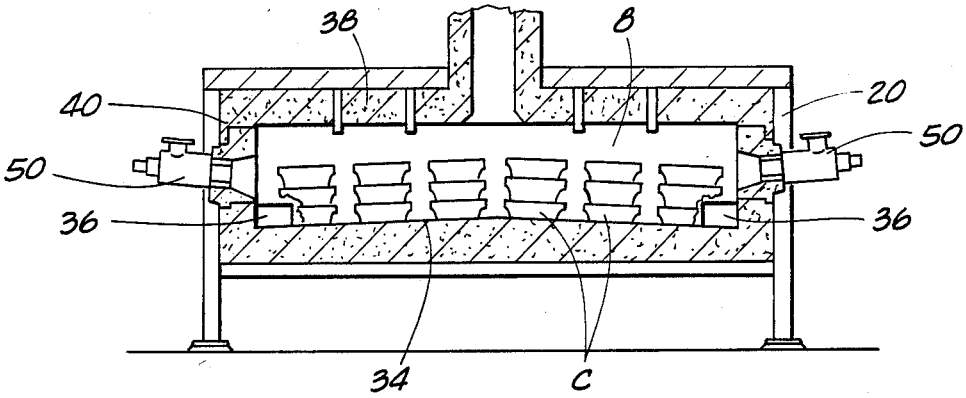
FIG. 5 is an elevational sectional view taken along line 5—5 of FIG. 4 and showing the sweat chamber.

Referring now to the drawings, a furnace A (FIGS. 1 & 2) serves as a source of molten aluminum for a manufacturing operation such as casting the aluminum into configurations dictated by the shape of a mold or extruding into shapes determined by an extrusion die. To this end, the furnace A contains a bath B of molten aluminum, and this molten aluminum may be derived from scrap aluminum products, such as expended beverage cans, or it may be derived from aluminum sows C (FIGS. 3 & 5) which are ingots that are normally obtained from a refiner of aluminum ore.

The bath B is for the most part contained in a primary or main chamber 2 (FIG. 2), although some of it is in a pumping well 4 (FIG. 3) and still more is in a charging well 6, both of which are located to one side of the main chamber 2. Actually, the main chamber 2, pumping well 4 and charging well 6 are all connected such that molten aluminum will flow from the main chamber 2 into the pumping well 4 to thereafter circulate through the charging well 6 and back into the main chamber 2, but the upper surface of the bath B remains at the same elevation in all three. The sows C, on the other hand, are placed in a sweat chamber 8 which is located to the other side of the main chamber 2. The main chamber 2, the two wells 4 and 6, and the sweat chamber 8 are enclosed by various walls which are for the most part formed from a refractory material, such as refractory brick. Finally, the furnace A includes a flue system 10 which receives heated gases and products of combustion from the main chamber 2 and sweat chamber 8, as well as volatilized substances from charging well 6.

Figure 4:
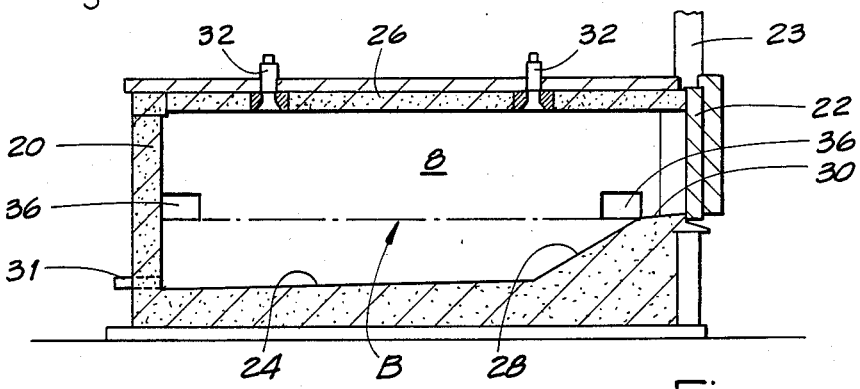
FIG. 4 is an elevational sectional view taken along line 4—4 of FIG. 3 and showing the main chamber.

Among the walls which enclose the main chamber 2 (FIGS. 2–4) are a pair of spaced apart side walls 16 and 18 and an end wall 20 which connects the side walls 16 and 18 at one end of the chamber 2. The other end of the chamber 2 is closed by doors 22 (FIG. 4) which, like the walls 16, 18 and 20, are formed from a refractory material and are for all intents and purposes walls themselves. However, the doors 22 may be raised with a hoist mechanism 23 to expose the main chamber 2. The side walls 16 and 18 and the end wall 20 extend downwardly to a floor 24 as well as upwardly to a roof 26, both of which are flat and generally horizontal. However, the floor 24 at one end of the chamber 2 has a ramp 28 that leads up to the doors 22. Actually, the ramp 28 leads up to a sill 30 which in turn extends outwardly toward the lower ends of the doors 22. While the sill 30 is higher than the upper surface of the molten bath B, the bath covers most of the ramp 28. Thus, the bath B is confined at one end by the end wall 20, at its opposite end by the ramp 28, and along its sides by the side walls 16 and 18.

The end wall contains a tap 31 (FIG. 4) through which molten aluminum may be withdrawn from the furnace A on a continuous or intermittent basis.

The roof 26 contains several burners 32 (FIGS. 2 & 4—shown in phantom lines on FIG. 3) which are directed downwardly into the main chamber 2 and produce enough heat at a temperature high enough to maintain the aluminum that comprises the bath B in a molten condition. Since the upper portion of main chamber 2, that is the portion which is not occupied by the bath B, is confined on all four sides by refractory walls, or more particularly on its sides by the side walls 16 and 18 and on its ends by the wall 20 and doors 22, the burners 32 not only direct heat into the metal bath B, but also into the surrounding walls 16, 18, 20, and 22 which in turn reradiate the heat into the bath B, and the same holds true with regard to the roof 26. In this regard, the space between the roof 26 and the upper surface of the bath B exceeds the depth of the bath B, so that a relatively large surface area exists around and over the bath B. This almost total confinement of the main chamber 2 provides maximum heating efficiency.

The sweat chamber 8 (FIGS. 2, 3 & 5) exists on the opposite side of the side wall 16 so the side wall 16 is actually a division wall which separates the two chambers 2 and 8. At its bottom the sweat chamber 8 has a hearth 34 which slopes downwardly at a slight inclination toward the side wall 16 and the main chamber 2, its lower margin being slightly higher than the upper surface of the bath B. Indeed, the side wall 16 near its ends is provided with ports 36, the lower surfaces of which are flush with the upper surface of the sweat hearth 34. Here the hearth 34 has its lowest elevation, so that any metal which melts in the sweat chamber 8 flows downwardly across the sweat hearth 34 and thence through the ports 36 into the bath B to add to the metal of the bath B. In terms of cross-sectional area, the ports 36 are just large enough to accommodate flue gases from the main chamber 2.

The sweat hearth 34 (FIGS. 2, 3 & 5) forms the floor of the sweat chamber 8 and is located opposite a roof 38 which is at about the same elevation as the roof 26 of the main chamber 2. The sweat chamber 8 is likewise enclosed by refractory walls, one of these walls being the side wall 16 which separates the sweat chamber 8 from the melting chamber 2. Another, is the end wall 20 which extends laterally beyond the side wall 16 to form one end of the sweat chamber 8. Still another is an end wall 40 which is located at the opposite end of the sweat chamber 8 and extends laterally from the side wall 16. The remaining side of the sweat chamber 8, that is the side located opposite to the side wall 16, is closed by a pair of doors 42 (FIGS. 1 & 2) having upwardly extending hangers 44 which normally loop over brackets 46 that are set above the roof 38 of the sweat chamber 8. When the hangers 44 rest on the brackets 40, the doors 42 completely close the side of the sweat chamber 34, but the doors 42 are attached to a hoist mechanism 48 which when activated, elevates the doors 34 enough to expose the sweat chamber 8, so that the aluminum sows C may be placed on the sweat hearth 34 to be thereafter melted.

The end walls 20 and 40 contain burners 50 (FIGS. 3 & 5) which are directed into the sweat chamber 8 to provide a flame which supplies enough heat at a temperature high enough to melt aluminum sows C that are on the sweat hearth 34. Of course, the flames from the burners 50 not only heat the sows directly, but also heat the walls 16, 20 and 40, the doors 42, the hearth 34, and the roof 38, all of which are formed from refractory material, and these surfaces reradiate heat to the sows C to facilitate their conversion to a liquid state. Thus, the sweat chamber 8 likewise avails itself of a most efficient heating principle.

The pumping well 4 (FIG. 3), which is located on the opposite side of the melting chamber 2 from sweat chamber 8, is rectangular in configuration, it being closed on one side by the side wall 18 and on its other side by a short wall 54. One end of the pumping well 4 is closed by the end wall 20 which extends beyond the side wall 18, while the opposite end is closed by a division wall 56 which extends between the side wall 18 and the outside wall 54. Moreover, the pumping well 4 has a refractory floor which is at the same elevation as the floor 24 of the main chamber 2, and indeed the main chamber 2 and pumping well 4 are in communication through an opening 60 in the side wall 18, that opening being submerged in the bath B so the molten aluminum will flow from the main chamber 2 into the pumping well 4. The division wall 56 on the other hand has an opening 62 which provides communication between the pumping well 4 and the charging well 6, and that opening is likewise submerged in the bath B. Located in the pumping well 4 is a pump 64 which draws molten aluminum from the main chamber 2 through the opening 60 in the side wall 18 and into the pumping well 4 and further discharges that molten aluminum from the pumping well 4 through the opening 62 in the separating wall so that it passes into the charging well 6. The walls 18, 20, 54, and 56 which surround the pumping well 4 support a cover 66 (FIG. 1) which extends over the well 4 to contain heat within it. However, the cover 66 may be removed to service the pump 4.

The charging well 6 (FIGS. 3 & 5) is likewise rectangular, it being closed on one side by the side wall 18 and on another by the division wall 56. Along its bottom is a floor 70 which is at the same elevation as, or in other words flush with, the floor 24 of the main chamber 2. The two other sides of the charging well 6 are enclosed by relatively steep ramps 72 which extend upwardly from the floor 70 at an angle of about 45° with respect to the floor 70 and at the surface of the bath B merge into dross ramps 74 of lesser pitch.

The side wall 18 near the floors 24 and 70 of the main chamber 2 and charging well 6 has another opening 76 (FIG. 3) which provides communication between the well 6 and chamber 2, and this permits molten aluminum to flow from the charging well 6 back into the bath B in the main chamber 2. Indeed, the pump 64 circulates the molten aluminum through the charging well 6, causing it to flow into the well 6 at the opening 62 in the separating wall 56 and out of the well 6 at the opening 76 in the side wall 18.

Extended over the charging well 6 is a fume hood 80 (FIGS. 1 & 2) having openings at the outer margins of the dross ramps 74, and these openings are normally closed by doors 82 which are connected to hoist-type elevating mechanisms 86. When either of the doors 82 is elevated, the charging well 6 is exposed through the opening normally covered by that door 80. Thus, with the door 80 elevated, a charge of scrap aluminum, such as expended beverage cans, aluminum turnings, or aluminum sheet metal, may be introduced into the portion of the bath B contained within the charging well 6. Paints, grease and similar substances on the scrap immediately volatilize and collect within the fume hood 76. Of course, the scrap eventually melts within the charging well 6 to become part of the bath B. Also, when either door 80 is open, an attendant may rake the dross that collects in the charging well 6 upwardly onto and over the dross ramps 74 at that door 80.

The flue system 10 includes (FIG. 2) two discharge stacks 90 and 92, each of which at its upper end opens into a connecting pipe 94 which in turn opens into a fume reactor 96 that is located over the roof 26 of the main chamber 2, but is not connected directly to the main chamber 2. Indeed, the reactor 96 communicates with the main chamber 2 only through the discharge stack 90. That stack, which is rectangular in cross-sectional configuration, is lined with refractory material that has a ledge or damper seat 98 intermediate its ends and an opening 100 adjacent to that seat. Indeed, the sides of the seat 98 are inclined downwardly to the lower margin of the opening 100 where a refractory damper 102 is hinged to the stack 94. The damper 102 possesses a flat closure wall 104 and an arcuate upper wall 106, the latter being concentric with respect to the hinge axis for the damper 102. Both are lined with refractory material. Like any damper, the damper 102 moves between open and closed positions, but irrespective of its position, the arcuate wall lies along the upper margin of the opening 100. When the damper 102 is closed, the flat closure wall 104 at its periphery rests on the damper seat 98, forming a reasonably good seal with it so as to block the flow of hot gases from the melting chamber 2. On the other hand, when the damper 102 is open, the flat closure 104 lies generally within the opening 100, and while the damper 102 permits hot gases to rise through the discharge stack 94, it nevertheless prevents them from escaping at the opening 100. Thus, the hot gases from the main chamber 2 are directed into the connecting pipe 96 and thence into the reactor 96. At its lower end the damper 102 possesses an operating arm 108 to which a double acting hydraulic or pneumatic cylinder 110 is connected for moving the damper 102 between its open and closed positions.

The connecting pipe 96 at the upper end of the discharge stack 90 not only directs hot gases from the stack 90 into the reactor 96, but further receives fumes from the fume hood 80 of the charging well 6 as well. In this connection, the fume hood 80 is connected with the upper end of the discharge stack 90 through a duct 112 (FIG. 2) containing a damper 114.

The other discharge stack 92 (FIG. 2) extends upwardly from the roof 38 of the sweat chamber 8 over which it is centered (FIG. 5—phantom lines in FIG. 3), its cross-sectional area being about equal to the combined cross-sectional area of the two ports 36 in the side wall 16. Actually, the cross-sectional area of the two ports 36 should range between 1 and 1.5 times the cross-sectional area of the stack 92 where the stack 92 opens into the sweat chamber 8. The stack 92 likewise possesses a damper seat 116, an opening 118, and a refractory damper 120 which correspond in configuration and operation to the seat 98, opening 100 and damper 102 for the stack 94, respectively. Moreover, the damper 120 is operated by another double acting cylinder 122.

The two connecting pipes 94 lead into the base of the reactor 96 which contains (FIGS. 2 & 6) a cylindrical reaction chamber 124 and a disk-like separator 126 at the bottom of that chamber, that is between the reaction chamber 124 and the ends of the connecting pipes 94. In addition the reactor 96 has two burners 128 which are directed generally tangentially into the reaction chamber 124 to produce a swirling combustion which further consumes volatiles that are derived primarily from the charging well 6. The reaction chamber 124 of the reactor 96 opens into a final stack 130 through which the hot and cleansed gases are vented to the atmosphere.

OPERATION

During the normal operation of the furnace A, the bath B exists in a molten condition in the main chamber 2, the pumping well 4 and the charging well 6 which are all interconnected below the upper surface of the bath B. Thus, the upper surface of the bath B is essentially at the same elevation at all three locations, and that elevation should be no higher than the lower margin of the sill 30 for the main chamber 2 and the lower margins of the dross ramps 74 for the charging well 6.

The pump 64 within the pumping well 4 causes the molten aluminum to flow from the main chamber 2 to the pumping well 4 and thence into the charging well 6, whereupon it returns to the main chamber 2, this circulation being made possible by submerged openings 60 and 100 in the side wall 18 and the opening 62 in the separating wall 56.

Molten aluminum is withdrawn from the furnace A from time to time at the tap 31 so as to provide molten aluminum for a casting, extruding or some other manufacturing operation.

To maintain the bath B in a molten condition, the burners 32 in the roof 26 of the main chamber 2 operate to direct flames into the upper portion of the main chamber 2, that is, the portion that is above the bath B. The heat produced by the flames from the burners 32 is absorbed by the aluminum of the bath B as well as by the walls 16, 18 and 20, the doors 22 and the roof 26 which line the main chamber 2 and indeed almost totally enclose the upper portion of the main chamber 2 with surface areas. While these surface areas absorb heat, they also reradiate the heat to the bath B within the main chamber 2, and to achieve maximum reradiation, it is desirable to have the ports 36 as small as possible. On the other hand, at this time in the operation the refractory damper 120 above the sweat chamber 8 is open, while the refractory damper 102 above the main chamber 2 is closed (FIG. 2), and this causes the hot gases resulting from the combustion at the burners 32 to flow through the ports 36 in the side wall 16, whereupon they pass through the sweat chamber 8 and into the discharge stack 92 that leads away from the chamber 8. Thus, the ports 36 should be large enough to accommodate all of the flue gases from the main chamber 2, and hence their combined cross-sectional size should be about as great as the cross-sectional size of the interior of the discharge stack 92. The sweat burners 50 remain off at this point in the operation.

Light aluminum scrap, such as expended beverage cans, aluminum turnings, and aluminum sheet metal remaining from blanking operations, is introduced into the furnace A at the charging well 6 by raising one of the doors 82 on the fume hood 80 and depositing the scrap in the molten aluminum bath B within the charging well 6. Any lacquers, paint or hydrocarbons on the scrap immediately volatilize and pass upwardly into the duct 112 that leads away from the fume hood 80. The duct 112 directs these fumes into the nearby connecting pipe 94 which in turn directs them into the reactor 96 where they enter the swirl in the reaction chamber 124 and are consumed by the flames discharged from the burners 128 which produce that swirl. Oxidized aluminum together with contaminants on the scrap produce a solid waste, known as dross, which floats on the surface of aluminum bath B within the charging well 6. From time to time the dross is removed by raising one of the doors 82 for the fume hood 80 and raking the dross up over the dross ramp 74 at that door.

Rarely is enough scrap available to supply the needs of the furnace A, and indeed the primary needs are supplied from aluminum ingots, usually referred to as sows, which are placed in the sweat chamber 8 where they rest upon the sweat hearth 34. Before opening the doors 42 to load the sweat chamber 8, the burners 32 for the main chamber 2 are shut off, and of course the burners 50 for the sweat chamber 8 are likewise off. Then the sows C are stacked on the sweat hearth 34 and the doors 42 are closed.

The sows C are next preheated in the sweat chamber 8, and this is achieved by operating the furnace A in essentially the manner previously described. More specifically, the damper 102 in the stack 90 leading from the main chamber 2 is left closed, while the damper 120 in the stack 92 leading from the sweat chamber 8 remains open. Moreover, the burners 32 in the main chamber 2 are reignited, and of course the heat which is produced maintains the bath B in a molten condition. The hot gases which develop pass through the ports 36 in the division wall 16 and through the sweat chamber 8 where they elevate the temperature of the sows C. Indeed, the temperature of the sows C rises well above the boiling point of water, so that any water that may be trapped in shrinkage cracks possessed by such sows boils off and escapes through the discharge stack 92. Thus, in this mode of operation the heat produced by the flames issuing from the burners 32 not only serves to maintain the bath B in a molten condition, but further serves to preheat the sows in order to purge them of all water.

Once the sows C reach the maximum temperature to which the gases from the main chamber 2 are capable of elevating them, they may be melted within the sweat chamber 8, provided the main chamber 2 has enough capacity to accept the volume of aluminum contained within the sows C. To melt the sows C the burners 32 of the main chamber 2 are shut off and the refractory dampers 102 and 120 are reversed, that is the damper 120 in the stack 92 leading from the sweat chamber 8 is closed, while the damper 102 in the stack 90 leading from the main chamber 2 is opened. The burners 50 for the sweat chamber 8 are energized, and they project flames in the sweat chamber 8. These flames heat the sows C as well as the surrounding walls 16, 20, 38, 40, and 42 which enclose the sweat chamber 8, and those walls of course radiate heat back to the sows C. Thus, maximum heat is extracted within the chamber 8 from the flames issuing from the two burners 50, and that heat melts the sows C. The molten aluminum flows across the sweat hearth 34 to the ports 36, and thence through the ports 36 into the bath B, thus adding to the aluminum in that bath B.

The hot gases produced by the flames that issue from the burners 50 likewise pass out of the sweat chamber 8 through the ports 36 in the wall 16, and enter the upper portion of the main chamber 2 through which they pass as they flow toward and into the discharge stack 90 for that chamber. In so doing they maintain the walls 16, 18, 20, 22, and 26 of the main chamber 2 at essentially their operating temperature and indeed maintain the bath B in a molten condition. Thus, in this mode of operation the heat from the burners 50 likewise is utilized in two locations, that is in the sweat chamber 8 where it melts the sows C and in the main chamber 2 where it maintains the bath B in a molten condition.

Once the sows C are totally melted, the furnace is returned to its normal mode of operation. To this end, the burners 50 are shut down, the dampers 102 and 120 are again reverse so that the former is closed and the latter is opened, and the burners 32 are reignited.

Furthermore, the presence of the side or division wall 16, which separates the main chamber 2 from the sweat chamber 8, enables workmen to load sows C onto the sweat hearth 34 without being exposed to the intense heat of the bath B in the main chamber 2. The side wall 16 further renders the furnace A safe to operate, because the sows C cannot be accidentally pushed off of the sweat hearth 34 and into the molten bath B.

While the construction and operation of the furnace has been described in connection with aluminum metal, the furnace A may be used to provide a molten supply of some other metal as well.

This invention is intended to cover all changes and modifications of the example of the invention herein chosen for purposes of the disclosure which do not constitute departures from the spirit and scope of the invention.

What is claimed is:

1. A process for providing a source of molten metal, said process comprising: confining molten metal in a main chamber so that a bath of the molten metal exists in the main chamber; directing a flame into the main chamber to heat the metal in the main chamber and maintain it molten; placing rearwardly large solid pieces of metal in a sweat chamber that is separated from the main chamber by a division wall which contains at least one port through which the sweat chamber communicates with the main chamber, the total cross-sectional area of the port or ports being substantially less than the corresponding cross-sectional area of the chambers beyond either end of the ports; venting the main chamber through the sweat chamber and thence through a vent that leads away from the sweat chamber so as to preheat the solid pieces of metal in the sweat chamber; thereafter directing a flame into the sweat chamber to melt the solid pieces of metal in the sweat chamber allowing the molten metal in the sweat chamber to flow into the bath within the main chamber; and while the flame is directed into the sweat chamber, venting the sweat chamber through the port or ports, the main chamber and another vent that leads away from the main chamber, so that the heat produced in the sweat chamber serves to maintain the bath in the main chamber molten.

2. The process according to claim 1 and further comprising maintaining some of the bath in a pumping well and a charging well located adjacent to the main chamber, the two wells being in communication with each other and with the main chamber below the surface of the bath, whereby the surface of the bath exists at the same level in the melting chamber and the pumping and charging wells; from within the pumping well imparting movement to the molten metal of the bath so as to cause the molten metal to circulate through the pumping and charging wells; and introducing relatively light scrap metal into the bath at the charging well.

3. The process according to claim 1 wherein the lower surface of the sweat chamber is above the upper surface of the bath in the main chamber, and the sweat chamber communicates with the main chamber along the lower surface of the sweat chamber, whereby when metal is melted in the sweat chamber, it drains by gravity into the bath in the main chamber.

4. The process according to claim 3 wherein the total cross-sectional area of the port or ports is about the same as the cross-sectional area of the vent that leads away from the sweat chamber.

5. The process according to claim 1 wherein the floor of the sweat chamber is above the molten metal in the main chamber and the port in the division wall extends down to the floor of the sweat chamber so that molten metal in the sweat chamber in flowing into the bath in the main chamber passes through the port.

6. A process for providing a source of aluminum metal, said process comprising: confining a molten metal to a bath in a main chamber having a first vent extended from it, there being a first damper in the first vent; placing solid pieces of the same metal in a sweat chamber which through at least one opening is in communication with the main chamber, the total cross-sectional area of the opening or openings being substantially smaller than the corresponding cross-sectional areas of the chambers immediately beyond the openings, the sweat chamber further having a second vent extended from it, there being a second damper in the second vent; closing the first damper and opening the second damper; thereafter directing a flame into the main chamber, with the flame producing enough heat to maintain the bath within the main chamber in a molten condition, whereby the heated gases produced by the flame pass through the opening between the two chambers and into the sweat chamber where they preheat the solid pieces of metal in the sweat chamber and then leave the sweat chamber through the second vent; after the solid pieces of metal in the sweat chamber are preheated, reversing the dampers so that the first damper is open and the second damper is closed; after the dampers are reversed, directing a flame into the sweat chamber with the flame producing enough heat to melt the preheated solid pieces of metal, whereby the metal melts and the heated gases produced by the flames in the second chamber flow through the opening between the chambers and into the main chamber through which they pass and are thereafter exhausted through the first vent, so that the gases from sweat chamber supply heat to the bath in the main chamber; and directing molten metal from the sweat chamber into the bath of molten metal in the main chamber.

7. The process according to claim 6 wherein the flame directed into the main chamber is extinguished before the flame is directed into the sweat chamber, and vice-versa.

8. The process according to claim 7 wherein the sweat chamber has a floor which is at an elevation higher than the upper surface of the bath in the main chamber and the sweat chamber communicates with the main chamber at the floor of the sweat chamber so that the molten metal produced in the sweat chamber drains into the main chamber.

9. The process according to claim 7 wherein the opening between the two chambers has a total cross-sectional area which is between 1 and 1.5 times the cross-sectional area of the second vent.

10. A furnace for holding a supply of molten metal, said furnace comprising: first walls enclosing a main chamber for containing a bath of the molten metal; first burners directed into the main chamber above the surface of the bath therein; a first discharge stack opening at its lower end into the main chamber; a first damper in the first stack and being movable between open and closed positions with respect to the first stack; second walls which in combination with at least one of the first walls enclose a sweat chamber, so that said one first wall of the main chamber constitutes a division wall that separates the main chamber from the sweat chamber, another of the walls of the sweat chamber being a sweat hearth on which relatively large pieces of metal are supported in the sweat chamber, the sweat hearth being at an elevation higher than the upper surface of the bath in the main chamber, the division wall that separates the main and sweat chambers containing at least one port for enabling hot gases produced by the first burners in the main chamber to flow into the sweat chamber and the total cross-sectional area of the port or ports being substantially smaller than the corresponding cross-sectional area of either chamber along the division wall, the division wall further permitting molten metal on the sweat hearth to flow into the bath in the main chamber; second burners directed into the sweat chamber for elevating the temperature of metal pieces placed therein high enough to melt those metal pieces; a second discharge stack opening at its lower end into the sweat chamber; and a second damper in the second stack and being movable between open and closed positions with the respect to the second stack.

11. A furnace according to claim 10 and further comprising means enclosing a pumping well which communicates with the main chamber below the surface of the bath and means enclosing a charging well which communicates with the pumping well and the main chamber below the surface of the bath, whereby the surface of the bath exists at the same elevation in the main chamber, pumping well and charging well, and a pump in the pumping well for circulating molten metal from the main chamber through the pumping well and charging well.

12. A furnace for providing a supply of molten metal, said furnace comprising: walls enclosing a main chamber for containing a bath of the molten metal, one of the walls of the main chamber being an upright side wall; first heating means for heating and elevating the temperature of the main chamber; walls enclosing a sweat chamber that communicates with the main chamber such that molten metal in the sweat chamber will flow into the main chamber, one of the walls of the sweat chamber being a sweat hearth on which relatively large pieces of the metal are placed, the sweat hearth being located at an elevation higher than the upper surface of the bath in the main chamber and generally sloping downwardly toward that bath, another of the walls of the sweat chamber being vertical and also serving as the upright side wall of the main chamber, whereby the upright side wall separates the main and sweat chambers, the upright side wall containing ports through which the sweat chamber communicates with the melting chamber, the ports being located low enough to enable molten metal to drain from the sweat hearth into the bath in the melting chamber; second heating means for heating and elevating the temperature of the sweat chamber; a first discharge vent opening into the main chamber and leading away from that chamber; a first damper in the first vent, the first damper being movable between open and closed positions with respect to the first vent; a second discharge vent opening into the sweat chamber and leading away from that chamber; and a second damper in the second vent, the second damper being movable between open and closed positions with respect to the second vent.

13. A furnace according to claim 12 wherein the first heating means comprises at least one burner in a wall of the melting chamber above the molten metal therein, and the second burner heating comprises at least one burner in a wall of the sweat chamber.

14. A furnace according to claim 12 wherein the combined cross-sectional size of the ports in the side wall ranges between 1 and 1.5 times the cross-sectional size of the second vent.

15. A furnace according to claim 12 wherein one of the walls enclosing the sweat chamber is a door which may be moved to expose the sweat chamber so that pieces of metal may be loaded into it.

16. A furnace according to claim 12 and further comprising means enclosing a pumping well which communicates with the main chamber below the surface of the bath; means enclosing a charging well which communicates with pumping well and the main chamber below the surface of the bath, so that the surface of the bath exists at the same elevation in the melting chamber, the pumping well, and the charging well; and a pump in the pumping well for causing molten metal from the bath in the main chamber to circulate through the pumping well and charging well.

17. A furnace according to claim 16 and further comprising a hood over the charging well and a duct leading from the hood and communicating with one of the vents so that fumes from the charging well are directed into one of the vents.

18. A furnace for holding a supply of molten metal, said furnace comprising: first walls enclosing a main chamber for containing a bath of the molten metal; first burners directed into the main chamber above the surface of the bath therein; a first discharge stack opening at its lower end into the main chamber; a first damper in the first stack and being movable between open and closed positions with respect to the first stack; second walls which in combination with at least one of the first walls enclose a sweat chamber, so that said one first wall of the main chamber constitutes a division wall that separates the main chamber from the sweat chamber, another of the walls of the sweat chamber being a sweat hearth on which relatively large pieces of metal are supported in the sweat chamber, the sweat hearth being at an elevation higher than the upper surface of the bath in the main chamber, the division wall that separates the main and sweat chambers containing at least one port for enabling hot gases produced by the first burners in the main chamber to flow into the sweat chamber; second burners directed into the sweat chamber for elevating the temperature of metal pieces placed therein high enough to melt those metal pieces; a second discharge stack opening at its lower end into the sweat chamber; and a second damper in the second stack and being movable between open and closed positions with respect to the second stack, the total cross-sectional area of the port in the division wall ranging between about 1 and 1.5 times the cross-sectional area of the second stack where the second stack opens into the sweat chamber.

19. A furnace according to claim 18 wherein the port in the division wall extends down to the sweat hearth so that molten metal on the sweat hearth drains through the port and into the bath in the main chamber.

20. A furnace for holding a supply of molten metal, said furnace comprising: first walls enclosing a main chamber for containing a bath of the molten metal; first burners directed into the main chamber above the surface of the bath therein; a first discharge stack opening at its lower end into the main chamber; a first damper in the first stack and being movable between open and closed positions with respect to the first stack; second walls which in combination with at least one of the first walls enclose a sweat chamber, so that said one first wall of the main chamber constitutes a division wall that separates the main chamber from the sweat chamber, another of the walls of the sweat chamber being a sweat hearth on which relatively large pieces of metal are supported in the sweat chamber, the sweat hearth being at an elevation higher than the upper surface of the bath in the main chamber, the division wall that separates the main and sweat chambers containing at least one port for enabling hot gases produced by the first burners in the main chamber to flow into the sweat chamber, the port in the division wall extending down to the sweat hearth so that molten metal on the sweat hearth drains through the port and into the bath in the main chamber; second burners directed into the sweat chamber for elevating the temperature of metal pieces placed therein high enough to melt those pieces; a second discharge stack opening at its lower end into the sweat chamber; and a second damper in the second stack and being movable between open and closed positions with respect to the second stack.

* * * * *

UNITED STATES PATENT AND TRADEMARK OFFICE

CERTIFICATE OF CORRECTION

PATENT NO. : 4,578,111

DATED : March 25, 1986

INVENTOR(S) : John R. Gillespie and Daniel M. Corley

It is certified that error appears in the above-identified patent and that said Letters Patent are hereby corrected as shown below:

Title page under the heading ABSTRACT, line 21, at the beginning of the line, "opened" should be deleted. The sentence should end with "reversed".

Column 1, line 25, "so a" should be "so as".

Column 8, Claim 1, line 51, "rearwardly" should be "relatively".

Signed and Sealed this

First Day of July 1986

[SEAL]

*Attest:*

DONALD J. QUIGG

*Attesting Officer*

*Commissioner of Patents and Trademarks*